US007334357B1

(12) United States Patent
Altheide

(10) Patent No.: US 7,334,357 B1
(45) Date of Patent: Feb. 26, 2008

(54) SNOWPLOW IMPACT REDUCTION SYSTEM

(76) Inventor: Charles E. Altheide, P.O. Box 78, Bloomfield, IA (US) 52537

( * ) Notice: Subject to any disclaimer, the term of this patent is extended or adjusted under 35 U.S.C. 154(b) by 157 days.

(21) Appl. No.: 10/974,416

(22) Filed: Oct. 27, 2004

(51) Int. Cl.
*E01H 5/04* (2006.01)

(52) U.S. Cl. ..... 37/231; 37/232; 280/485

(58) Field of Classification Search ..... 37/231, 37/266; 280/484, 485, 483
See application file for complete search history.

(56) References Cited

U.S. PATENT DOCUMENTS

| | | | | |
|---|---|---|---|---|
| 2,144,357 | A * | 1/1939 | Booharin | 293/136 |
| 2,508,836 | A | 5/1950 | Morris | |
| 2,999,697 | A | 9/1961 | Winget | |
| 3,238,647 | A * | 3/1966 | Hall et al. | 172/816 |
| 3,349,507 | A | 10/1967 | Payne | |
| 3,828,449 | A | 8/1974 | Miceli | |
| 3,851,894 | A | 12/1974 | St. Pierre | |
| 3,883,965 | A * | 5/1975 | Poirier et al. | 37/232 |
| 3,987,562 | A | 10/1976 | Deen | |
| 4,215,496 | A | 8/1980 | Wehr | |
| 4,470,211 | A * | 9/1984 | Rossmann | 37/231 |
| 4,570,367 | A * | 2/1986 | Oya | 34/232 |
| 4,746,138 | A * | 5/1988 | James | 280/487 |
| 4,843,744 | A * | 7/1989 | Jansen | 37/232 |
| 4,969,280 | A * | 11/1990 | Thorneloe | 37/281 |
| 5,075,988 | A * | 12/1991 | Ciula | 37/231 |
| 5,109,618 | A * | 5/1992 | Grubler et al. | 37/232 |
| 5,136,795 | A | 8/1992 | Rosenberg | |
| 5,380,030 | A | 1/1995 | Gullickson | |
| 5,638,617 | A * | 6/1997 | Belanger et al. | 37/270 |
| 5,823,560 | A * | 10/1998 | Van Vleet | 280/484 |
| 6,269,556 | B1 * | 8/2001 | Kallqvist | 37/233 |
| 6,581,953 | B2 * | 6/2003 | Jerry | 280/486 |
| 6,618,965 | B1 * | 9/2003 | Schultz et al. | 37/232 |
| 6,846,126 | B2 * | 1/2005 | Parent | 403/379.3 |
| 6,931,770 | B2 * | 8/2005 | Belzile | 37/231 |
| 6,957,825 | B2 * | 10/2005 | Peters | 280/483 |

* cited by examiner

*Primary Examiner*—Thomas A. Beach
(74) *Attorney, Agent, or Firm*—McKee, Voorhees & Sease, P.L.C.

(57) ABSTRACT

An improved front hitch assembly is provided for mounting a snowplow to the front of a vehicle. The hitch assembly includes a pair of mounting brackets secured to the vehicle frame, and a pair of receivers releasably connected to the mounting brackets. The plow includes a frame with a pair of horns which are releasably received in the receivers. A pad is provided in each of the mounting brackets and is engaged by each of the receivers to absorb impact forces when the plow hits an object. The brackets include pairs of forward and rearward slots for supporting the receivers in the brackets, with the pads being mounted on the rearward pins. The pads are made of polymeric or urethane material so as to absorb the forces of impact when the plow hits an object.

20 Claims, 3 Drawing Sheets

30
30
28
34
32
24
26
20
40
32
40
24
38
36
42
46
22
44
48
52
50

SNOWPLOW IMPACT REDUCTION SYSTEM

BACKGROUND OF THE INVENTION

Snowplows which are mounted on the front of a truck or other vehicle are typically connected to the truck frame using a rigid carriage. The rigid connection of the plow to the frame easily transfers impact loads from the plow to the frame, and potentially causes damage to the truck. For example, if the plow hits a street curb while plowing, the force of the impact is transmitted through the plow and mounting carriage to the truck frame. Trip springs have been provided on the rear surface of the plows in an effort to minimize the impact forces. However, some of the forces are still transferred to the frame.

Therefore, a primary objective of the present invention is the provision of a front-mount snowplow impact resistance system which absorbs the forces of impact resulting from the plow hitting an object.

Another objective of the present invention is the provision of an improved front hitch assembly for a snowplow which minimizes the transfer of impact forces when the plow hits an object.

Another objective of the present invention is the provision of impact-absorbing pads installed in the mounting brackets of a front snowplow hitch assembly.

A further objective of the present invention is the provision of an impact resistive snowplow for the front of a vehicle which is economical to manufacture and durable in use.

These and other objectives will become apparent from the following description of the invention.

SUMMARY OF THE INVENTION

The impact resistant hitch assembly of the present invention is intended for use with a snowplow mounted on the front of a vehicle. The hitch assembly includes left and right mounting brackets which are secured to the vehicle frame. The hitch assembly further includes left and right receivers which are removably connected to the mounting brackets. The snowplow includes a frame with left and right horns which extend rearwardly for removable receipt in the left and right receivers. Impact absorbing pads are mounted in the mounting brackets and engageable by the receivers so as to absorb forces of impact resulting from the snowplow hitting an object, such as a curb. The mounting brackets include slots, with pins extending through the slots and through each of the receivers, such that the receivers are moveable forwardly and rearwardly relative to the respective brackets. The pads are mounted to the brackets using the receiver mounting pins.

DETAILED DESCRIPTION OF THE PREFERRED EMBODIMENT

Figure 1:
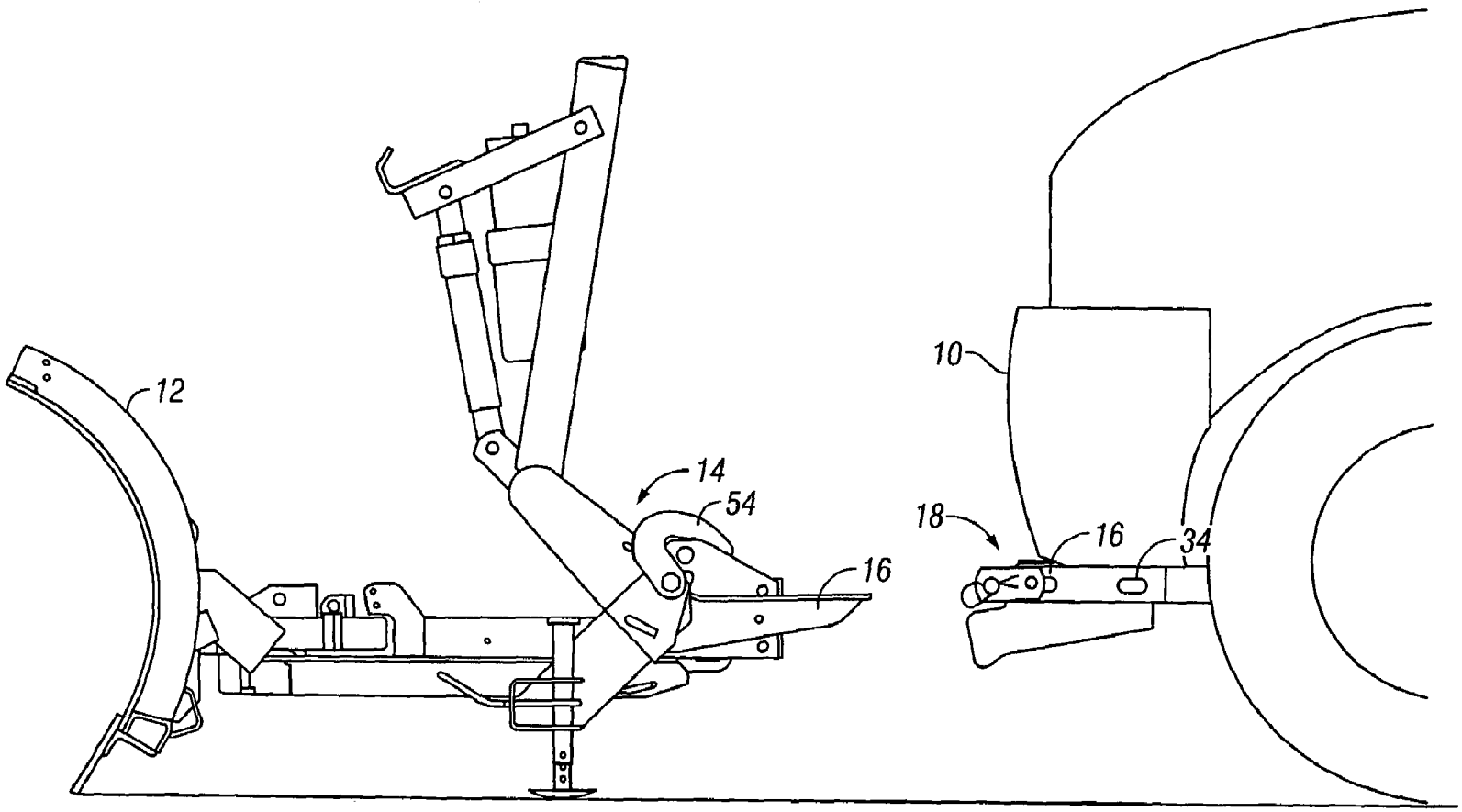
FIG. 1 is a side elevation view of a front mounted snowplow and the impact resistant hitch assembly of the present invention.

In FIG. 1, the front end of a vehicle is generally designated by the reference numeral 10, with the snowplow which is mounted to the front of the vehicle 10 being designated by the reference numeral 12. The plow 12 includes a frame 14 which extends rearwardly and terminates in left and right plow horns 16 which are adapted to be received in a hitch assembly 18 mounted to the frame of the vehicle 10. The structure of the snowplow 12 and the frame 14, as shown in the drawings, is conventional.

Figure 2:
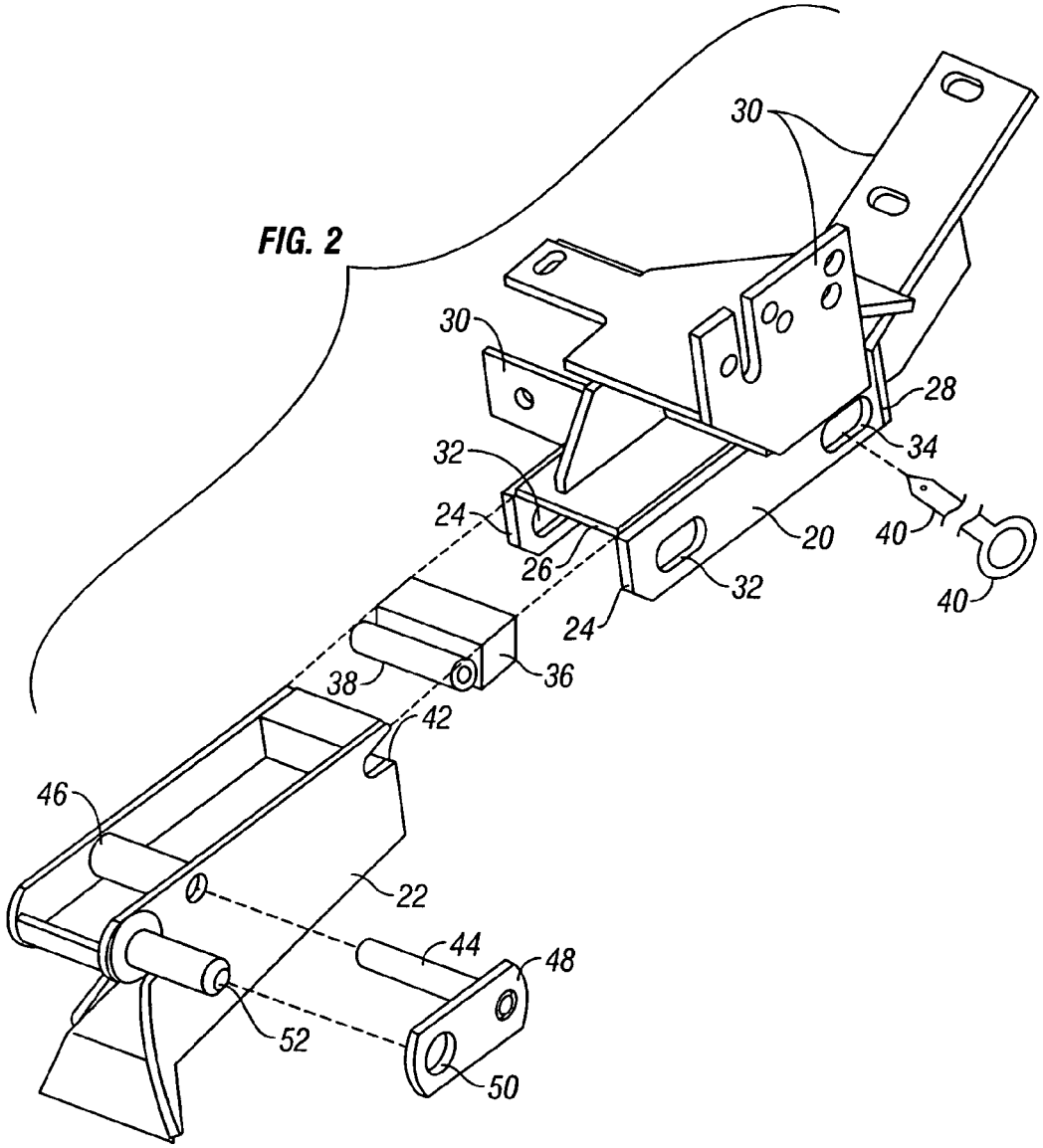
FIG. 2 is an exploded perspective view of the left hand mounting bracket, receiver, and impact absorbing pad of the present invention.

The hitch assembly generally includes left-hand and right-hand mounting brackets 20 and left-hand and right-hand receivers 22. The left-hand bracket 20 and receiver 22 is shown in FIG. 2, with the right-hand bracket and receiver being a mirror image. Each bracket 20 includes opposite sidewalls 24, and an upper wall 26 so as to define an inverted U-shaped channel in which the receiver 22 is mounted. A rear wall 28 extends between the sidewalls 24 at the rearward end of each bracket 20. Flanges extend from each bracket 20 for connecting the bracket 20 to the frame of the vehicle 10. The flanges 30 may take various shapes and sizes, depending upon the style of vehicle to which the hitch assembly 18 is being mounted. For example, in FIG. 2, the flanges 30 are illustrated for mounting to 1991 Chevy truck.

The opposite sidewalls 24 of each bracket 20 include a pair of front slots 32 and a pair of rear slots 34. An impact-absorbing pad 36 resides between the sidewalls 24 of each bracket 20 adjacent the rear slots 34. Each pad includes a bushing 38 which is aligned with the rear slots 34 and adapted to receive a pin 40 so as to retain the pad 36 in position within the bracket 20. Each pad 36 is free to slide forwardly and rearwardly between the bracket sidewalls 24 along the length of the slots 34. The pin 40 is retained in the slots 34 by a cotter pin (not shown).

When the receivers 22 are positioned within the brackets 20, a notch 42 in the rear end of each receiver 22 engages the bushing 38 of the pad 36 on each side of the hitch assembly 18. A second pin 44 extends through the front slots 32 of each bracket 20 and through a bushing 46 on each receiver 22. The pin 44 has a plate 48 on one end with an aperture 50 in the plate 48. The plate 48 is adapted to be received on the stub shaft 52 of each receiver 22, and is retained by a cotter pin 53. After the plow horns 16 are inserted into the receivers 22, a hook 54 on each side of the plow frame 14 is pivoted over the shafts 52 on each of the receivers 22 to retain the plow 12 on the frame of the vehicle 10.

It is understood that the pads 36 may be mounted in the receivers 22, as an alternative to the preferred mounting in the brackets 20. For such an alternative arrangement, an internal wall would be provided in the receivers 22 against which the pads would abut, and slots would be provided in the sidewalls of the receivers 22 to allow relative forward and rearward movement between the receiver and the bracket.

In use, when the plow hits an object, such as a curb, the forces of impact are transmitted through the plow frame 14 and receivers 22, which slide rearwardly relative to the brackets 20 via the slots 32, 34, with the pads 36 absorbing much of the impact forces. Thus, the pads 36 minimize the amount of impact forces which are transferred to the vehicle frame.

The pads 36 are made of a material which absorbs impact forces. Preferred materials are a polymer or urethane. One example of useful pad material is urethane UB83 manufactured by Albert Manufacturing in Des Moines, Iowa.

Figure 3:
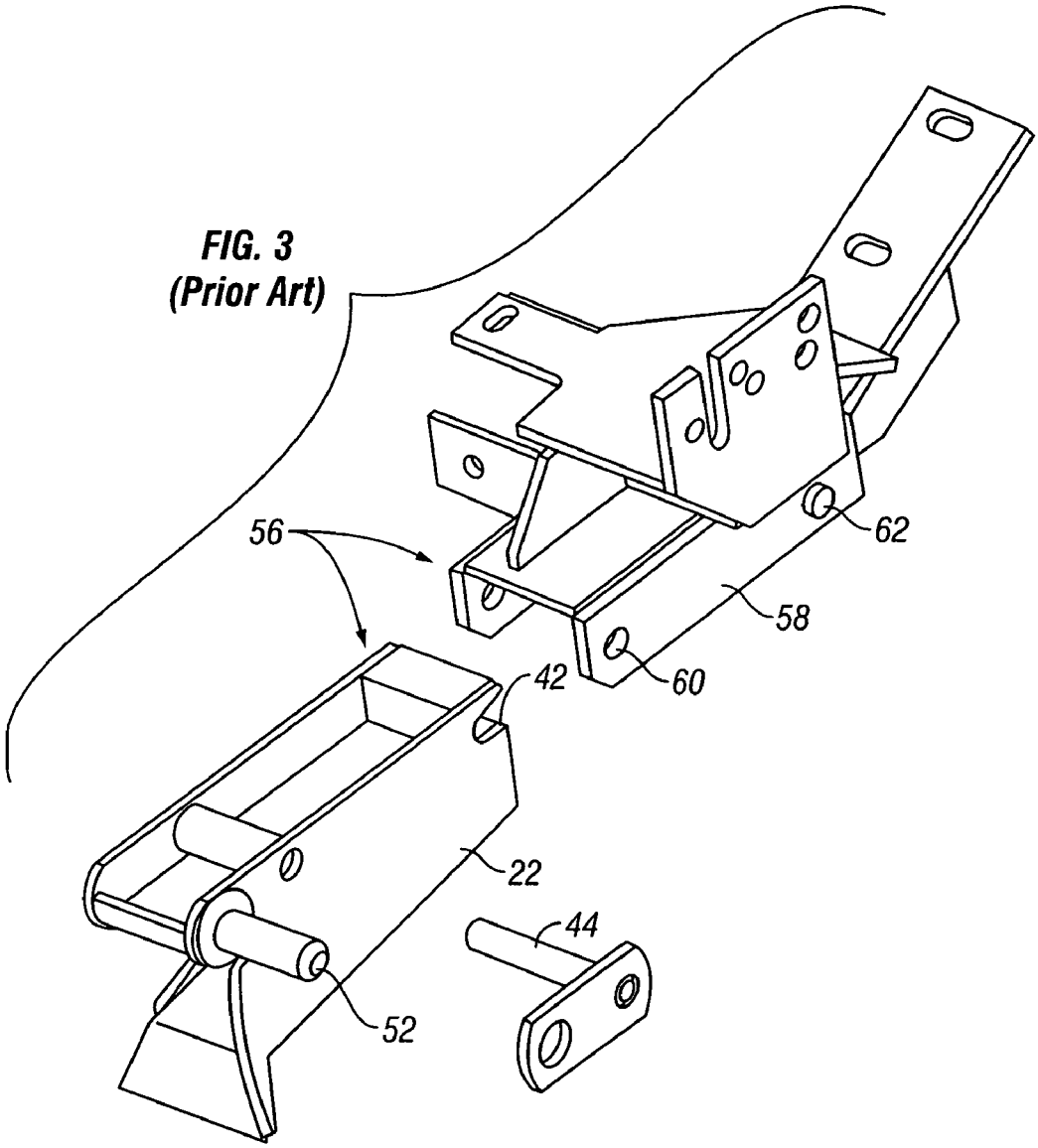
FIG. 3 (Prior Art)
FIG. 3 is a view similar to FIG. 2 showing the prior art mounting bracket and receiver.

FIG. 3 shows a prior art hitch assembly 56 with a left-hand mounting bracket 58 and a left-hand receiver 22, which is identical to the receiver 22 shown in FIG. 2. The main difference between the prior art hitch assembly 56 shown in FIG. 3 and the hitch assembly 18 of the present invention shown in FIG. 2, is that the brackets 20 of the current invention include the slots 32, 34 and the pads 36, which are not present in the hitch assembly 56 of the prior art. Rather, the hitch assembly 56 includes an aperture 60 through which the pin 44 extends. Also, the pins 40 of the present invention are replaced with pins 62 on each side which are welded to the brackets 58 so as to be fixed thereto. Thus, the prior art hitch assembly 56 has no impact absorption, and forces generated by the plow hitting an object are transferred to the frame of the vehicle 10.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A front mount snowplow impact resistance system, comprising:

left and right mounting brackets adapted to be secured to a vehicle frame, and each mounting bracket including slots;

left and right receivers slidably connected to the left and right mounting brackets by pins extending through the slots and through each receiver;

a plow with a frame having left and right horns extending rearwardly and being removably received in the left and right receivers; and left and right impact-absorbing pads mounted in the left and right mounting brackets to absorb forces of impact resulting from the plow hitting an object by compressing the pads such that the receivers slide relative to the brackets, so as to minimize transfer of the impact forces to the vehicle frame.

2. The system of claim 1 wherein each bracket has a rear wall and each pad is mounted adjacent the rear wall.

3. The system of claim 1 wherein each pad has a bushing, and each bracket includes a slot, and further comprising a pin extending through the bushing and slot to mount the pad to the bracket.

4. The system of claim 1 wherein the pads are a polymer material.

5. The system of claim 1 wherein the pads are a urethane material.

6. The system of claim 1 wherein the receivers are free to move rearwardly relative to the vehicle frame upon sufficient force of impact.

7. The system of claim 1 wherein the receivers are not fixed to the vehicle frame.

8. An improved front hitch assembly for mounting a snowplow to the front of a vehicle, the hitch assembly including a pair of the receivers slidably connected to a pair of mounting brackets connected to a frame of the vehicle, and the plow including a pair of horns releasably received the receivers, the improvement comprising:

front and rear slots in each bracket sidewall, and front and rear pins extending through the front and rear slots, respectively, and through each receiver to slidably connect the receivers to the brackets;

a pad in each mounting bracket and engaged by each receiver to compress and absorb impact forces when the plow hits an object as the receivers slide relative to the brackets; and the pads being located forwardly of the connections between the brackets and the vehicle frame, such that the absorbed forces are not transmitted to the vehicle frame.

9. The hitch assembly of claim 8 wherein the pads are mounted on the rear pins between the sidewalls of the bracket.

10. The assembly of claim 8 wherein the receivers are adapted to slide relative to the vehicle frame during use of the plow.

11. The assembly of claim 8 wherein the receivers are not fixed to the vehicle frame.

12. An improved front hitch assembly for mounting a snowplow to the front of a vehicle, the hitch assembly including a pair of the receivers slidably connected to a pair of mounting brackets secured to a frame of the vehicle, and the plow including a pair of horns releasably received in the receivers, the improvement comprising:

a pair of pads mounted in one of the pairs of brackets or receivers to compress and absorb impact forces when the plow hits an object and allow the receivers to slide relative to the brackets; and the receivers being free to slide forwardly and rearwardly relative to the vehicle frame during use of the snowplow.

13. The hitch assembly of claim 12 wherein the pads are mounted in the brackets.

14. The hitch assembly of claim 12 wherein the pads are mounted in the brackets.

15. The hitch assembly of claim 12 wherein the brackets include slots, and the receivers are slidably mounted to the brackets using pins extending through the slots and through the receivers.

16. The hitch assembly of claim 15 wherein each pad is mounted on one of the pins.

17. The hitch assembly of claim 12 wherein the pads are a polymer material.

18. The hitch assembly of claim 12 wherein the pads are a urethane material.

19. The assembly of claim 12 wherein the pads minimize transfer of impact forces to the vehicle frame.

20. The assembly of claim 12 wherein the receivers are not fixed to the vehicle frame.

* * * * *